US011590379B1

(12) United States Patent
LoDuca

(10) Patent No.: US 11,590,379 B1
(45) Date of Patent: Feb. 28, 2023

(54) EXERCISE APPARATUS

(71) Applicant: Offset Ventures LLC, Whitestone, NY (US)

(72) Inventor: Salvatore LoDuca, Whitestone, NY (US)

(73) Assignee: OFFSET VENTURES LLC, Whitestone, NY (US)

( * ) Notice: Subject to any disclaimer, the term of this patent is extended or adjusted under 35 U.S.C. 154(b) by 0 days.

(21) Appl. No.: 17/900,934

(22) Filed: Sep. 1, 2022

Related U.S. Application Data

(63) Continuation-in-part of application No. 17/573,086, filed on Jan. 11, 2022, now Pat. No. 11,433,269.

(51) Int. Cl.
*A63B 21/055* (2006.01)

(52) U.S. Cl.
CPC ..... *A63B 21/0555* (2013.01); *A63B 21/0557* (2013.01)

(58) Field of Classification Search
CPC ..... A63B 21/0004; A63B 21/00043; A63B 21/00178; A63B 21/00181; A63B 21/00185; A63B 21/002; A63B 21/0023; A63B 21/02; A63B 21/04; A63B 21/0407; A63B 21/0414; A63B 71/0054; A63B 2071/0063; A63B 2071/0072; A63B 2209/00; A63B 2209/02; A63B 2209/023; A63B 2209/026; A63B 2209/14; A63B 2225/09; A63B 21/0421; A63B 21/0428; A63B 21/0435; A63B 21/0442; A63B 21/055; A63B 21/0552; A63B 21/0555; A63B 21/0557; A63B 21/4023; A63B 21/4027; A63B 21/4033; A63B 21/4035
See application file for complete search history.

(56) References Cited

U.S. PATENT DOCUMENTS

| | | | | |
|---|---|---|---|---|
| 4,059,265 | A | 11/1977 | Wieder et al. | |
| 11,229,814 | B1 | 1/2022 | Weck et al. | |
| 11,433,269 | B1 * | 9/2022 | LoDuca | A63B 21/0555 |
| 2010/0227744 | A1 | 9/2010 | Dang | |
| 2014/0274613 | A1 | 9/2014 | DeMarco et al. | |
| 2015/0238799 | A1 | 8/2015 | Arline | |
| 2017/0182348 | A1 | 6/2017 | Bertolutti | |
| 2018/0236308 | A1 | 8/2018 | Hyde et al. | |
| 2019/0046830 | A1 | 2/2019 | Chiavegato et al. | |
| 2021/0370127 | A1 | 12/2021 | Konopacz et al. | |

FOREIGN PATENT DOCUMENTS

| | | | |
|---|---|---|---|
| KR | 20210112636 | A | 9/2021 |
| WO | 2018147889 | A1 | 8/2018 |

* cited by examiner

*Primary Examiner* — Gary D Urbiel Goldner
(74) *Attorney, Agent, or Firm* — Carter, DeLuca & Farrell LLP; George Likourezos

(57) ABSTRACT

An exercise apparatus includes first and second elastic, elongate cables each having a first end portion configured to be grasped by a user, and a second end portion configured to be detachably coupled to one another. The cables are together configured to provide resistance to being stretched along their lengths in response to an application of a tension force and return to their unstretched lengths upon the user releasing the tension force. The first cable has a first elasticity, and the second cable has a second elasticity that is different than the first elasticity of the first cable.

8 Claims, 8 Drawing Sheets

EXERCISE APPARATUS

CROSS-REFERENCE TO RELATED APPLICATION

The present application is a Continuation-in-Part Application of U.S. patent application Ser. No. 17/573,086, filed on Jan. 11, 2022, the entire contents of which being incorporated by reference herein.

FIELD

The present disclosure relates to an exercise apparatus and, more particularly, to an offset-loaded resistance band.

BACKGROUND

A common form of strength training is the use of elastic resistance bands where a user grasps opposing ends of the elastic band, cable, or cord and performs a pulling or pushing motion in a direction that stretches the band. Resistance bands are particularly useful because resistance increase as a user stretches the band. The increasing resistance counters momentum and lever arm advantages that reduce the effectiveness of conventional weight lifting in the course of an exercise movement such as a curl. However, conventional resistance bands are fabricated from a single band having the same degree of elasticity throughout.

SUMMARY

In recent years, sports physiologists have discovered that there are a number of benefits to offset loading, or asymmetric loading, in strength training. Offset loading is the use of different weights on either side of the body. This is typically achieved by using small hand-held dumbbells of different weights. For example, the lifter can do dumbbell curls with 10 pounds on one side and 15 pounds on the other side, or can do a dumbbell bench press with dumbbells of different weights, for example 25 pounds on the right side and 45 pounds on the left side.

There are a number of benefits to weight training with an offset load. The first is that it strengthens the muscles of the stomach and lower back. Since there are different weights on each side of the body, the core muscles are automatically engaged to keep the person stable. The second benefit is that it decreases the left to right muscular imbalance. Most people have stronger muscles on one side of the body simply because they have a dominant hand, which means that the arm of the dominant hand does far more work than the other arm. The body automatically compensates for the weaker side, and this creates an imbalance in the muscles of the body. The use of an offset load forces the weaker side to fully engage during the full motion of the exercise.

Accordingly, provided in accordance with aspects of the present disclosure is an exercise apparatus that allows a user to strength train using offset loading. The exercise apparatus includes an elastic, elongate cable having opposing first and second ends configured to be grasped by a user. The elongate cable is resiliently biased toward an unstretched length such that the elongate cable resists being stretched along its length in response to an application of a tension force to the first and second ends thereof and returns to the unstretched length upon a user releasing the tension force. The elongate cable includes a first portion having a first elastic modulus, and a second portion having a second elastic modulus that is different than the first elastic modulus of the first portion.

In aspects, the first portion of the elongate cable may be positioned between a central region of the elongate cable and the first end of the elongate cable, and the second portion of the elongate cable may be positioned between the central region of the elongate cable and the second end of the elongate cable.

In aspects, the first portion of the elongate cable may be positioned adjacent the first end of the elongate cable, and the second portion of the elongate cable may be positioned adjacent the second end of the elongate cable.

In aspects, the first portion of the elongate cable may have an end, and the second portion of the elongate cable may have an end that merges with the end of the first portion at a central region of the elongate cable.

In aspects, the first portion of the elongate cable may have a first end that forms the first end of the elongate cable and a second end. The second portion of the elongate cable may have a first end that forms the second end of the elongate cable and a second end. The second ends of the first and second portions may be adjacent one another at a central region of the elongate cable.

In aspects, the first portion of the elongate cable may have a length approximating a first half of the length of the elongate cable, and the second portion of the elongate cable may have a length approximating a second half of the length of the elongate cable.

In aspects, the first and second portions of the elongate cable may be fabricated from the same material, and the first portion of the elongate cable may be thicker than the second portion of the elongate cable.

In aspects, the first portion of the elongate cable may be fabricated from a different material than the second portion of the elongate cable.

In aspects, the first and second portions of the elongate cable may be monolithically formed with one another.

In aspects, the elongate cable may be fabricated from at least one of rubber or elastic fabric.

In aspects, the exercise apparatus may further include a first handle coupled to the first end of the elongate cable, and a second handle coupled to the second end of the elongate cable.

In accordance with another aspect of the present disclosure, a resistance band for strength training is provided that includes a first end having a first handle, a second end having a second handle, a central region between the first and second ends, a first portion having a first elastic modulus and positioned only between the first end and the central region, a second portion having a second elastic modulus that is different from the first elastic modulus. The second portion is positioned between the second end and the central region.

In aspects, the first portion may have an end, and the second portion may have an end that merges with the end of the first portion at the central region.

In aspects, the first portion may have a first end that forms the first end of the resistance band and a second end. The second portion may have a first end that forms the second end of the resistance band and a second end. The second ends of the first and second portions may be adjacent one another at the central region.

In aspects, the first and second portions may be fabricated from the same material, and the first portion may be thicker than the second portion.

In aspects, the first portion may be fabricated from a different material than the second portion.

In another aspect of the present disclosure, a resistance band for strength training is provided and includes first and second elastic, elongate cables each having opposing first and second end portions. The first end portion of each of the first and second cables are configured to be grasped by a user. The first cable has a first elastic modulus, and the second cable has a second elastic modulus that is different than the first elastic modulus of the first cable. Each of the first and second cables are resiliently biased toward an unstretched length such that the first and second cables resist being stretched along their length in response to an application of a tension force to the first end portions thereof and return to the unstretched length upon a user releasing the tension force. The resistance band further includes a first connector attached to the second end portion of the first cable, and a second connector attached to the second end portion of the second cable and configured to detachably couple to the first connector. Each of the first and second connectors includes a pair of male mating features, and a pair of female mating features configured for removable receipt of the respective pair of male mating features.

In aspects, each male mating feature of the pair of male mating features of the first connector may include a first projection extending perpendicularly from an end face of the first connector, and a second projection extending perpendicularly from the first projection.

In aspects, a first female mating feature of the pair of female mating features of the second connector may include a first recess defined in an end face of the second connector, and a second recess defined in the end face of the second connector and extending from the first recess. The first recess may be configured to receive the second projection, and the second recess may be sized to prevent axial withdrawal of the second projection from the second recess.

In aspects, the second projection may have a concave edge, and the second connector may have a convex inner surface positioned within the first and second recesses and configured to slidingly engage the concave edge of the second projection.

In aspects, the pair of male mating features of the first connector may be diametrically opposed L-shaped bosses, and the pair of female mating features of the second connector may be diametrically opposed arcuate channels configured for receipt of the respective pair of L-shaped bosses.

In aspects, the first and second cables may be fabricated from the same material, and the first cable may be thicker than the second cable.

In aspects, the first cable may be fabricated from a different material than the second cable.

In aspects, the first and second cables may be fabricated from at least one of rubber or elastic fabric.

As used herein, the term "distal" refers to the portion that is described which is further from a user, while the term "proximal" refers to the portion that is being described which is closer to the user. Terms including "generally," "about," "substantially," and the like, as utilized herein, are meant to encompass variations, e.g., manufacturing tolerances, material tolerances, use and environmental tolerances, measurement variations, and/or other variations, up to and including plus or minus 10 percent. Further, any or all of the aspects described herein, to the extent consistent, may be used in conjunction with any or all of the other aspects described.

As used herein, the terms parallel and perpendicular are understood to include relative configurations that are substantially parallel and substantially perpendicular up to about + or −10 degrees from true parallel and true perpendicular.

BRIEF DESCRIPTION OF THE DRAWINGS

The above and other aspects and features of the present disclosure will become more apparent in light of the following detailed description when taken in conjunction with the accompanying drawings wherein like reference numerals identify similar or identical elements.

DETAILED DESCRIPTION

Figure 1:
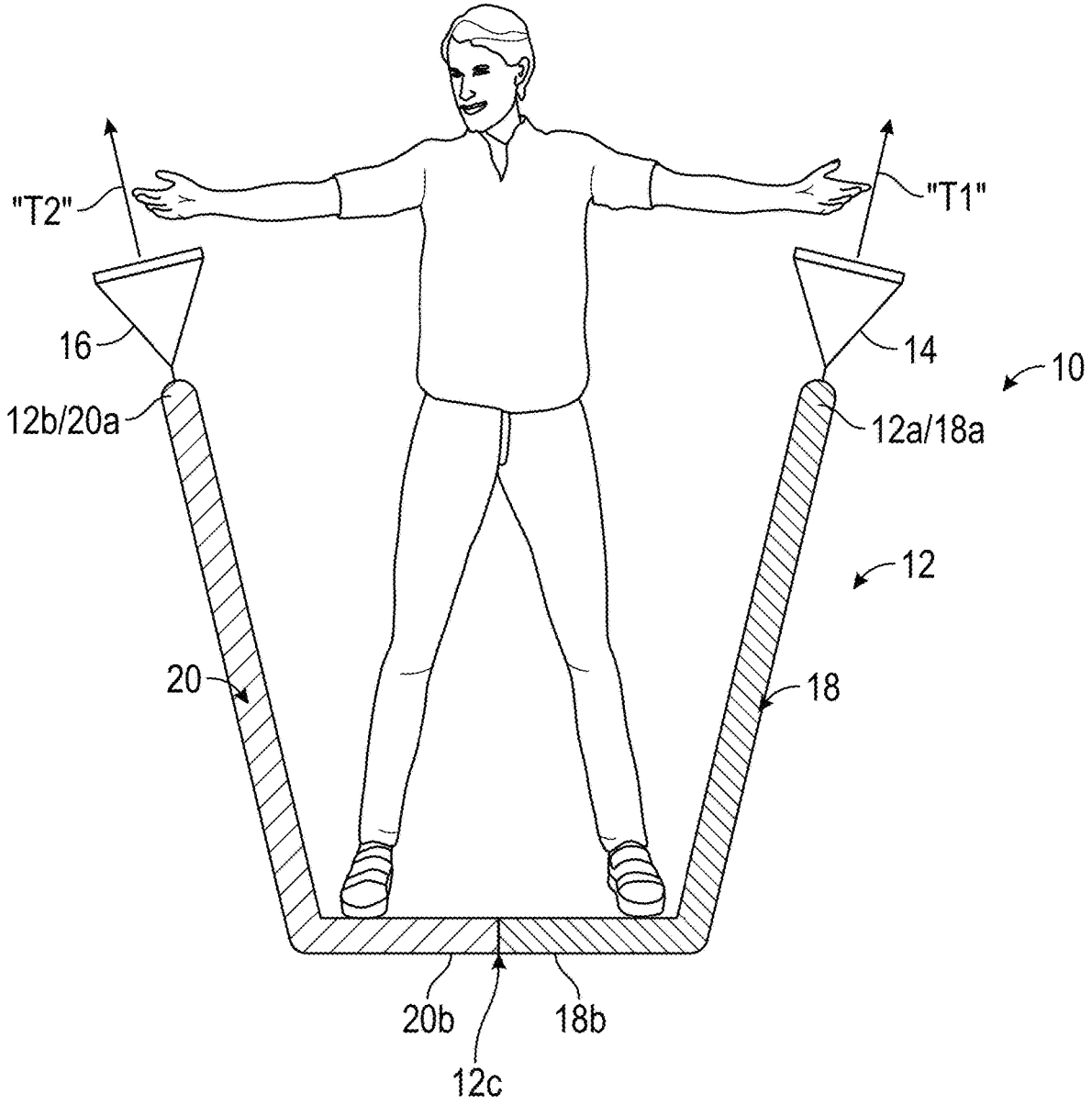
FIG. 1 is a front view of a user performing a strength training exercise with an exercise apparatus provided in accordance with the present disclosure.
Figure 2:
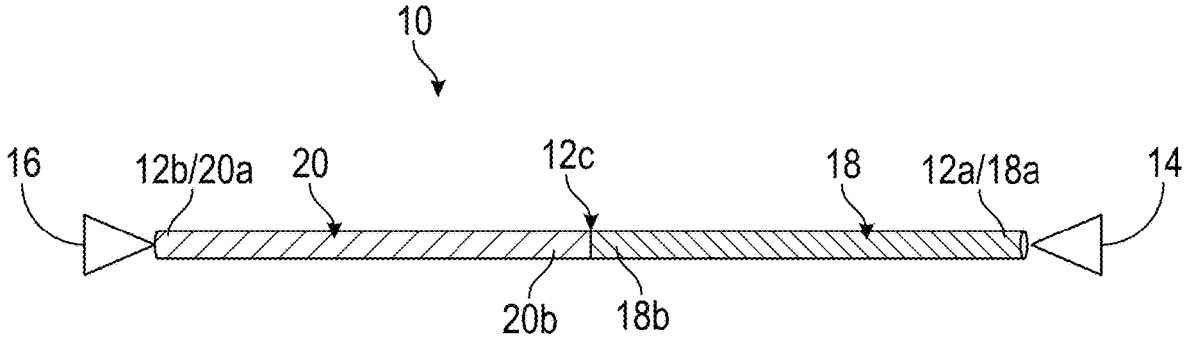
FIG. 2 is a front, perspective view illustrating the exercise apparatus of FIG. 1.

Turning to FIGS. 1 and 2, an exercise apparatus in accordance with aspects of the present disclosure is generally identified by reference numeral 10. The exercise apparatus 10 may be a resistance band including an elastic, elongate cable 12 and a pair of handle 14, 16 coupled to opposing first and second ends 12*a*, 12*b* of the elongate cable 12. In aspects, elongate the cable 12 may be a hollow cord, a solid cylindrical cable, a flattened band, or the like. The elongate cable 12 has a length from about 3 feet to about 5 feet. Other suitable sizes for the elongate cable 12 are also contemplated. The elongate cable 12 may be fabricated from an elastomeric material, such as, for example, rubber, or an elastic fabric. It is contemplated that the elongate cable 12 may be fabricated from any other suitable material configured to stretch under a tensile load and return to its original length when the tensile load is released.

The elongate cable 12 has the opposing first and second ends 12*a*, 12*b* supporting the first and second handles 14, 16, which are configured to be grasped by a user, and a central region 12*c* positioned between the first and second ends 12*a*, 12*b*. The handles 14, 16 may be permanently affixed to the first and second ends 12*a*, 12*b* of the elongate cable 12 or detachably secured to the first and second ends 12*a*, 12*b* of the elongate cable 12 via a hook and loop strap, shackle, knot, or the like. In other aspects, the first and second ends 12*a*, 12*b* of the elongate cable 12 may be devoid of handles.

The elongate cable 12 includes a first portion or segment 18 having a first elastic modulus, and a second portion or segment 20 having a second elastic modulus that is different than the first elastic modulus of the first portion 18. For example, the first portion 18 may be more elastic than the second portion 20 such that a greater tensile force is required to stretch the second portion 20 of the elongate cable 12 the same amount as the first portion 18. The first and second portions 18, 20 may be fabricated from the same material having different diameters or wall thicknesses from one another thereby giving each a different elastic modulus.

In other aspects, the first and second portions 18, 20 may have different elastic moduli from one another due to the first and second portions 18, 20 being fabricated from different materials. For example, the first portion 18 may be fabricated from a first type of rubber or elastic fabric having a predetermined elastic modulus whereas the second portion 20 may be fabricated from a second type of rubber or elastic fabric having a predetermined elastic modulus that is greater than the elastic modulus of the first portion 18.

The first portion 18 of the elongate cable 12 is positioned between the central region 12*c* of the elongate cable 12 and the first end 12*a* of the elongate cable 12, and the second portion 20 of the elongate cable 12 is positioned between the central region 12*c* of the elongate cable 12 and the second end 12*b* of the elongate cable 12. The first portion 18 of the elongate cable 12 may have a first end 18*a* positioned adjacent to or forming the first end 12*a* of the elongate cable 12, and a second end 18*b* positioned at and forming part of the central region 12*c* of the elongate cable 12. Similarly, the second portion 20 of the elongate cable 12 may have a first end 20*a* positioned adjacent to or forming the second end 12*b* of the elongate cable 12, and a second end 20*b* positioned at and forming part of the central region 12*c* of the elongate cable 12. The second ends 18*b*, 20*b* of the first and second portions 18, 20 may merge with one another, thereby together forming the central region 12*c* of the elongate cable 12. In aspects, the second ends 18*b*, 20*b* of the first and second portions 18, 20 may be monolithically formed with one another or integrally connected to one another.

The first portion 18 of the elongate cable 12 may have a length equal to a first half of the length of the elongate cable 12, and the second portion 20 of the elongate cable 12 may have a length equal to a second half of the length of the elongate cable 12 such that the first and second portions 18, 20 together make up the entire length of the elongate cable 12.

As shown in FIG. 1, to perform a particular exercise using the exercise apparatus 10, for example, bicep curls, a user may position their feet shoulders-width apart and on the elongate cable 12 with the central region 12*c* of the elongate cable 12 positioned between their feet. The user may grasp the handles 14, 16 of the exercise apparatus 10 with their respective left and right hands and apply a tensile force on the first and second ends 12*a*, 12*b* of the elongate cable 12 by bending their forearms upwardly about their elbows.

Since the second portion 20 of the elongate cable 12 has a different elastic modulus than the first portion 18 (e.g., a greater elastic modulus), for the user to lift or pull the handles 14, 16 upwardly at the same rate, the left arm of the user must apply a first tensile load "T1" and the right arm of the user must apply a second tensile load "T2" that is greater than the first tensile load "T1." In this way, the user is performing an offset loaded bicep curl. It is contemplated that other types of offset loaded exercises may be performed using the exercise apparatus 10, such as, for example, squats, lateral raises, leg press, tricep press, etc.

Figure 3:
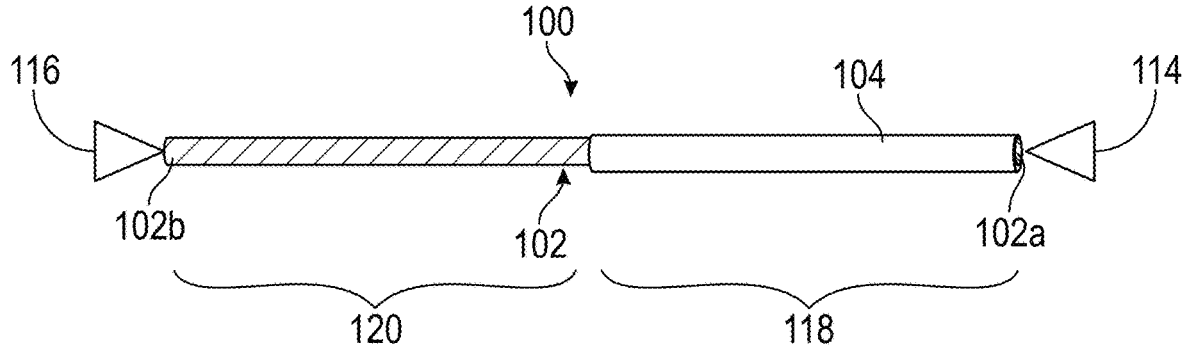
FIG. 3 is a front, perspective view illustrating another aspect of an exercise apparatus.

With reference to FIG. 3, another type of exercise apparatus 100 for offset loaded strength training or rehabilitation is shown. Exercise apparatus 100 is similar to and may include any of the features of exercise apparatus 10 (FIGS. 1 and 2) except as explicitly contradicted below.

Exercise apparatus 100 includes an elongate cable 102 having first and second ends 102*a*, 102*b*, and handles 114, 116 coupled to the respective first and second ends 102*a*, 102*b*. Instead of the elongate cable 102 having a different elasticity in different portions thereof as is the case in the exercise apparatus 10 of FIGS. 1 and 2, the entire length of the elongate cable 102 may be fabricated from a single elastic material with the same modulus of elasticity throughout. However, the exercise apparatus 100 further includes a sheath 104 that enshrouds only approximately a first half 118 of the elongate cable 102. As such, the sheath 104 gives the first half 118 of the exercise apparatus 100 a different elastic modulus than the second half 120, which is not covered by the sheath 104.

Figure 4:
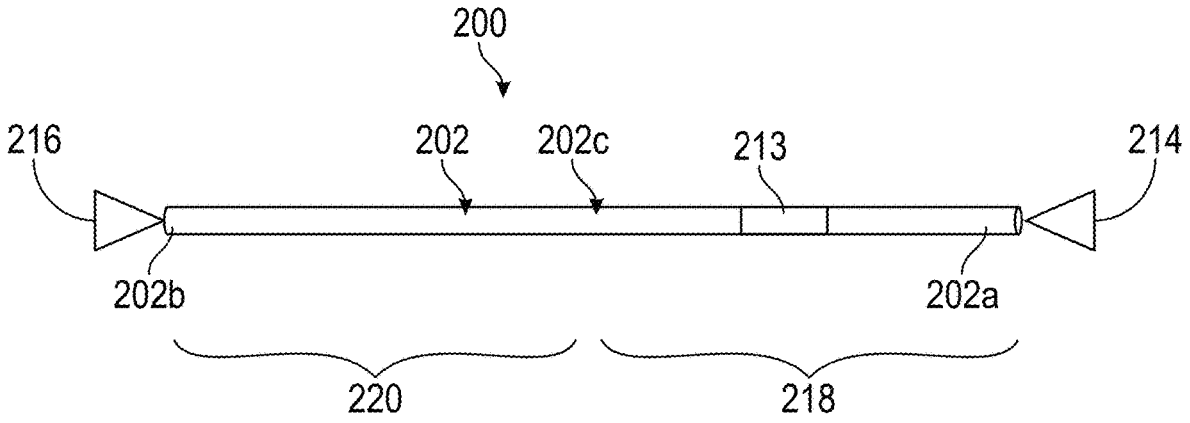
FIG. 4 is a front, perspective view illustrating yet another aspect of an exercise apparatus.
Figure 5:
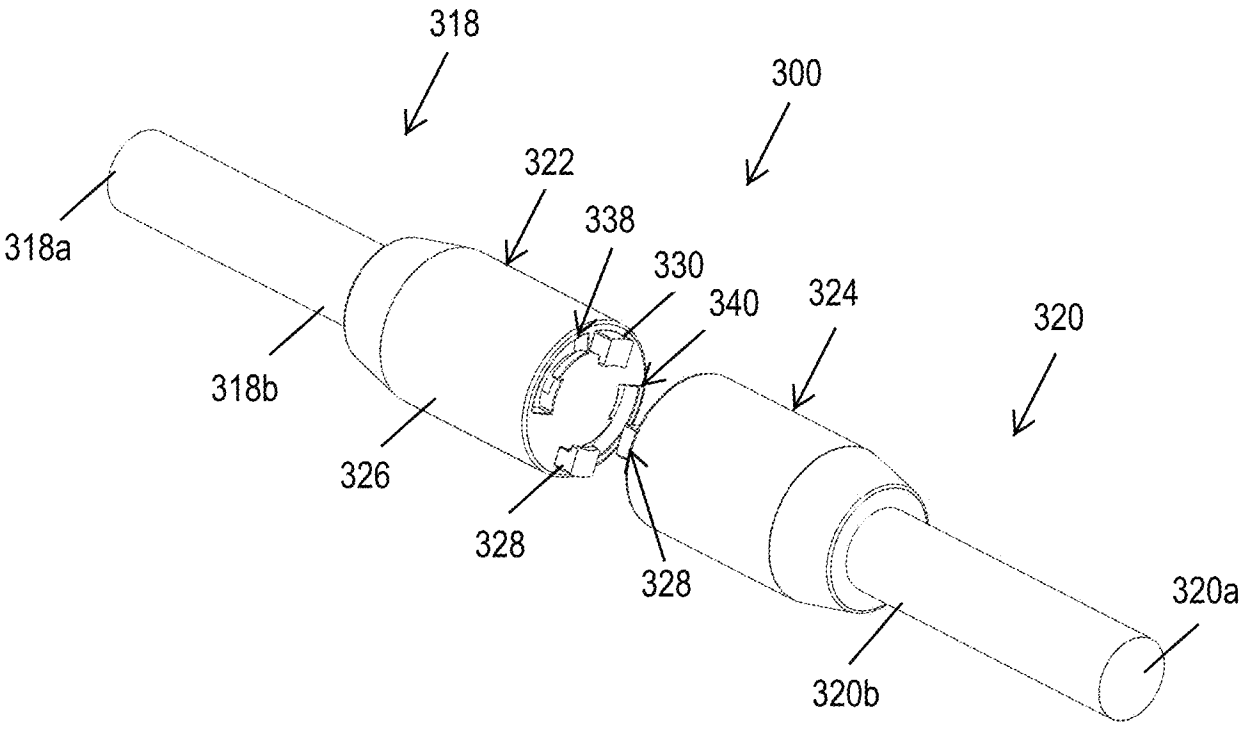
FIG. 5 is a perspective view illustrating two connectors of yet another aspect of an exercise apparatus with the two connectors shown in a detached state.
Figure 6:
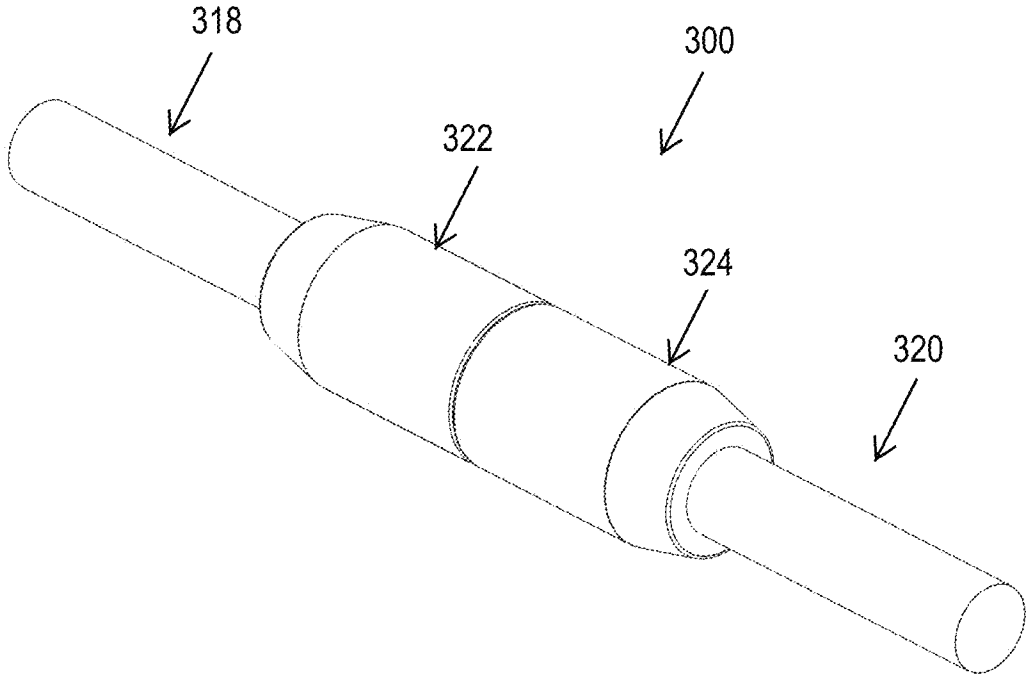
FIG. 6 is a perspective view illustrating the two connectors of FIG. 5 in a connected state.
Figure 7:
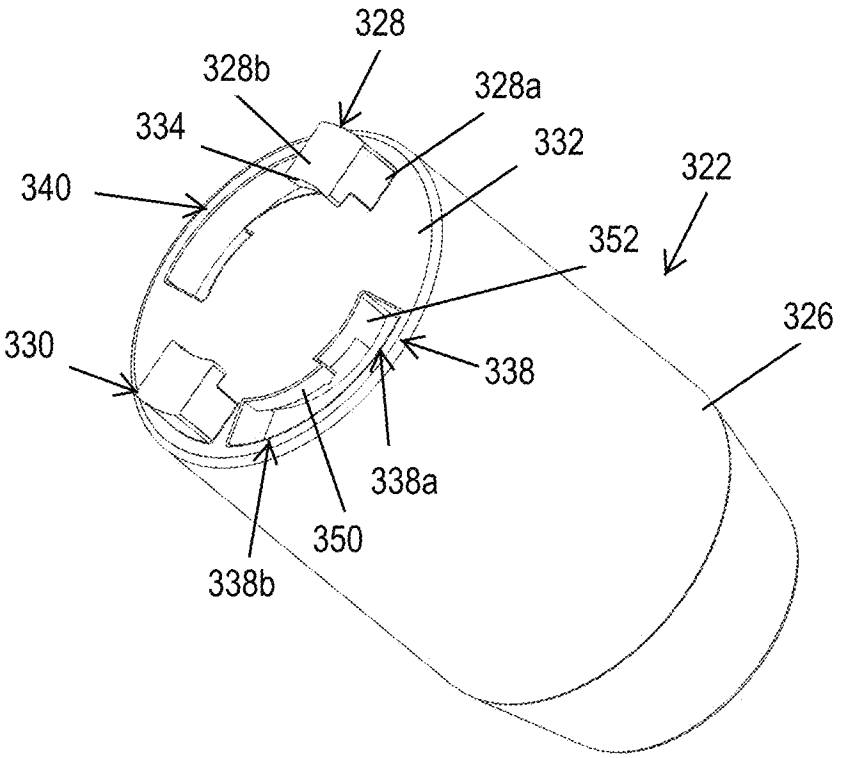
FIG. 7 is a front, perspective view illustrating mating parts of one of the connectors of FIG. 5.
Figure 8:
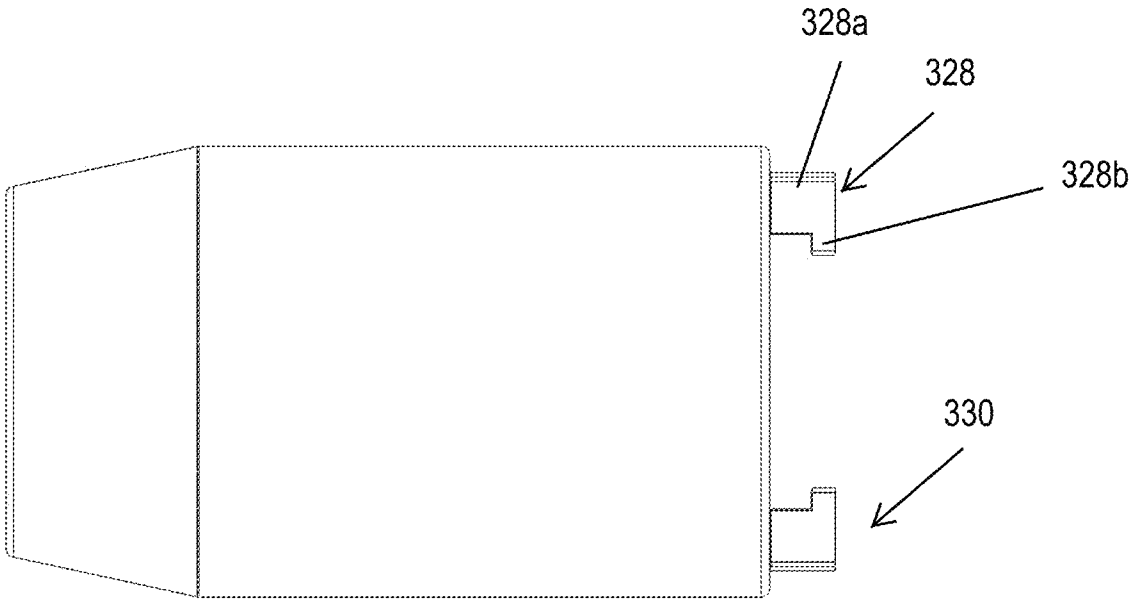
FIG. 8 is a side view illustrating one of the connectors of FIG. 5.
Figure 9:
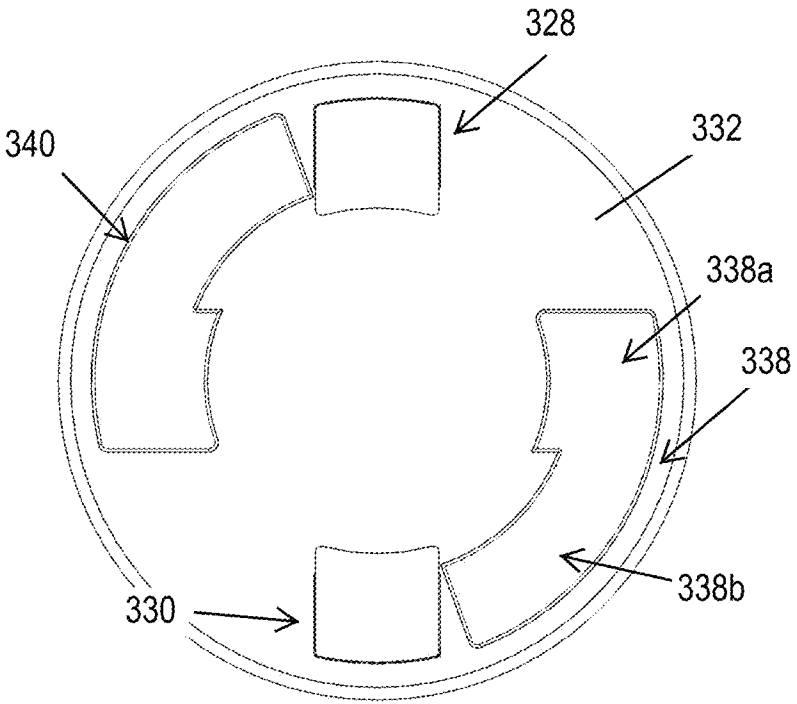
FIG. 9 is a front view illustrating the mating parts of one of the connectors of FIG. 5.

With reference to FIG. 4, another type of exercise apparatus 200 for offset loaded strength training or rehabilitation is shown. Exercise apparatus 200 is similar to and may include any of the features of exercise apparatus 10 (FIGS. 1 and 2) except as explicitly contradicted below.

Exercise apparatus 200 includes an elongate cable 202 having first and second ends 202*a*, 202*b*, a central region 202*c* between the first and second ends 202*a*, 202*b*, and handles 214, 216 coupled to the respective first and second ends 202*a*, 202*b*. The entire elongate cable 202 may be fabricated from a single material (e.g., rubber with a preset elastic modulus) but for a single segment 213 formed with the elongate cable 202 at a position between the central region 202*c* of the elongate cable 202 and the first end 202*a* of the elongate cable 202. The single segment 213 has a different modulus of elasticity than the remainder of the elongate cable 202 (e.g., a greater modulus of elasticity). As such, the half 218 of the elongate cable 202 with the segment 213 has a different overall modulus of elasticity than the half 220 of the cable 202 without the segment 213.

With reference to FIGS. 5-9, another type of exercise apparatus 300 for offset loaded strength training or rehabilitation is shown. Exercise apparatus 300 is similar to and may include any of the features of exercise apparatus 10 (FIGS. 1 and 2) except as explicitly contradicted below.

Exercise apparatus 300 may be a resistance band including a first elastic, elongate cable 18 and a second elastic, elongate cable 320 configured to be detachably coupled to one another. It is contemplated that the exercise apparatus 300 may be a kit of a plurality of elongate cables (e.g., more than two cables). The first and second elongate cables 318, 320 may have the same length, such as, for example, about 1.5 feet to about 2.5 feet. Other suitable sizes for the elongate cables 318, 320 are also contemplated. The elongate cables 318, 320 may be fabricated from an elastomeric material, such as, for example, rubber, or an elastic fabric. It is contemplated that the elongate cables 318, 320 may be fabricated from any other suitable material configured to stretch under a tensile load and return to its original length when the tensile load is released.

The first elongate cable 318 has a first elastic modulus, and the second elongate cable 320 has a second elastic modulus that is different than the first elastic modulus of the first elongate cable 318. For example, the first elongate cable 318 may be more elastic than the second elongate cable 320 such that a greater tensile force is required to stretch the second elongate cable 320 the same amount as the first elongate cable 318. The first and second elongate cables 318, 320 may be fabricated from the same material having different diameters or wall thicknesses from one another thereby giving each a different elastic modulus. It is contemplated that the exercise apparatus 300 may be a kit of two or more elongate cables with each having a different elastic modulus.

In other aspects, the first and second elongate cables 318, 320 may have different elastic moduli from one another due to the first and second elongate cables 318, 320 being fabricated from different materials. For example, the first elongate cables 318, 320 may be fabricated from a first type of rubber or elastic fabric having a predetermined elastic modulus whereas the second elongate cable 320 may be fabricated from a second type of rubber or elastic fabric having a predetermined elastic modulus that is greater than the elastic modulus of the first elongate cable 318.

Each of the first and second cables 318, 320 includes a first end portion 318*a*, 320*a* and an opposing second end portion 318*b*, 320*b*. The first end portion 318*a*, 320*a* of each of the first and second cables 318, 320 may support a handle (not explicitly show) configured to be grasped by a user. In aspects, the first end portion 318*a*, 320*a* of each of the first and second cables 318, 320 may be devoid of a handle.

The second end portion 318*b*, 320*b* of each of the first and second elongate cables 318, 320 supports a respective first and second connector 322, 324 configured to detachably couple to one another. Since the first and second connectors 322, 324 of each of the first and second elongate cables 318, 320 are identical, only the first connector 322 of the first elongate cable 318 will be described in detail herein. The first connector 322 generally includes a hub or body 326 and a pair of male mating features, such as, for example, bosses 328, 330, extending from an end face 332 of the body 326. The end face 332 of the body 326 may have a flat, circular shape and the pair of bosses 328, 330 extend from diametrically opposed sides of the end face 332. The bosses 328, 330 each have a first projection 328*a* extending perpendicularly from the end face 332, and a second projection 328*b* extending perpendicularly from the first projection 328*a*, such that the bosses 328, 330 assume an L-shape. The second projection 328*b* of each of the bosses has a concave edge 334. The second boss 330 is identical or substantially similar to the first boss 328.

The end face 332 of the connector 322 includes a pair of diametrically opposed female mating features, such as, for example, first and second channels 338, 340 configured to respectively receive first and second bosses of the second connector 324. Each of the channels 338, 340 are defined in the end face 332 and may have an arcuate shape that approximates the curvature of the end face 332. The first channel 338 has a first recess 338*a* having the same profile as the second projection 328*b* of the boss 328 such that the first recess 338*a* is dimensioned to axially receive the first boss 328 of the second connector 324 therein.

The first channel 328 further includes a second recess 338*b* extending from the first recess 338*a* and having the same profile as the first projection 328*a* of the boss 328 such that the second recess 338*b* is configured to rotationally receive (e.g., clockwise) the boss 328 of the second connector 324 therein while prohibiting axial withdrawal of the second projection 328*b* of the boss 328 of the second connector 324 therefrom. The second recess 338*b* has a smaller height (measured along a radial direction of the end face 332) than the first recess 338*a* due to a catch or lip 350 of the end face 332 that prevents the second projection 338*b* of the second connector 324 from being removed from the first channel 338 in the axial direction. The second channel 340 is identical or substantially similar to the first channel 338.

The first connector 322 may further include a convex inner surface 352 that defines a part of the channel 338 and is configured to slidingly engage the concave edge 334 of the boss 328 of the second connector 324 to assist with rotating the connectors 322, 324 relative to one another.

In use, the connectors 322, 324 of two elongate cables of the exercise apparatus 300, for example, the first and second elongate cables 318, 320, are positioned adjacent one another with the bosses 328, 330 of the first connector 322 facing the first recesses 338*a* of the channels 338, 340 of the second connector 324 and the bosses 328, 330 of the second connector 324 facing the first recesses 338*a* of the channels 338, 340 of the first connector 322. The connectors 322, 324 are then approximated toward one another in an axial direction to insert the bosses 328, 330 into the respective channels 338, 340. To lockingly engage the connectors 322, 324 to one another, one or both of the connectors 322, 324 are rotated to position the second projections 328*b* within the second recesses 338*b* and behind the lip 350 of the connectors 322, 324. To disconnect the connectors 322, 224 from one another, connectors 322, 324 are rotated in the opposite direction and then pulled apart.

While several aspects and features of the disclosure are detailed above and shown in the drawings, it is not intended that the disclosure be limited thereto, as it is intended that the disclosure be as broad in scope as the art will allow and that the specification be read likewise. Therefore, the above description and accompanying drawings should not be construed as limiting, but merely as exemplifications of particular configurations. Those skilled in the art will envision other modifications within the scope and spirit of the claims appended hereto.

What is claimed is:

1. A resistance band for strength training, comprising:

a first cable being elastic and elongate and having opposing first and second end portions, the first end portion being configured to be grasped by a user, the first cable having a first elastic modulus;

a second cable being elastic and elongate and having opposing first and second end portions, the first end portion of the second cable being configured to be grasped by the user, the second cable having a second elastic modulus that is different than the first elastic modulus of the first cable, each of the first and second cables being resiliently biased toward an unstretched length thereof such that the first and second cables resist being stretched in response to an application of a tension force to the first end portions thereof and respectively return to the unstretched length upon the user releasing the tension force;

a first connector attached to the second end portion of the first cable; and a second connector attached to the second end portion of the second cable and configured to detachably couple to the first connector, wherein each of the first and second connectors includes a pair of male mating features, and a pair of female mating features configured for removable receipt of the respective pair of male mating features.

2. The resistance band according to claim 1, wherein each male mating feature of the pair of male mating features of the first connector includes:

a first projection extending perpendicularly from an end face of the first connector; and a second projection extending perpendicularly from the first projection.

3. The resistance band according to claim 2, wherein a first female mating feature of the pair of female mating features of the second connector includes:

a first recess defined in an end face of the second connector, the first recess being configured to receive the second projection; and a second recess defined in the end face of the second connector and extending from the first recess, the second recess being sized to prevent axial withdrawal of the second projection from the second recess.

4. The resistance band according to claim 3, wherein the second projection has a concave edge, and the second connector has a convex inner surface positioned within the first and second recesses and configured to slidingly engage the concave edge of the second projection.

5. The resistance band according to claim 1, wherein the pair of male mating features of the first connector are diametrically opposed L-shaped bosses, and the pair of female mating features of the second connector are diametrically opposed arcuate channels configured for respective receipt of the diametrically opposed L-shaped bosses.

6. The resistance band according to claim 1, wherein the first and second cables are fabricated from a same material, and the first cable is thicker than the second cable.

7. The resistance band according to claim 1, wherein the first cable is fabricated from a different material than the second cable.

8. The resistance band according to claim 1, wherein the first and second cables are fabricated from at least one of rubber or elastic fabric.

* * * * *